US007007434B1

(12) United States Patent
Danielsson

(10) Patent No.: US 7,007,434 B1
(45) Date of Patent: Mar. 7, 2006

(54) BUILDING STRUCTURE ELEMENT AND STIFFENING PLATE ELEMENTS FOR SUCH AN ELEMENT

(76) Inventor: Erik Danielsson, Roslagsgatan 19, 5TR, Stockholm (SE) 113 55

( * ) Notice: Subject to any disclaimer, the term of this patent is extended or adjusted under 35 U.S.C. 154(b) by 0 days.

(21) Appl. No.: 09/958,153

(22) PCT Filed: Apr. 6, 2000

(86) PCT No.: PCT/SE00/00658

§ 371 (c)(1),
(2), (4) Date: Oct. 5, 2001

(87) PCT Pub. No.: WO00/60188

PCT Pub. Date: Oct. 12, 2000

(30) Foreign Application Priority Data

Apr. 6, 1999 (SE) ..... 9901219

(51) Int. Cl.
*E04B 2/46* (2006.01)
*E04C 1/40* (2006.01)

(52) U.S. Cl. ..... 52/426; 52/371; 52/353; 52/379; 52/330; 52/435

(58) Field of Classification Search ..... 52/321, 52/330, 787.1, 322, 426, 425, 435, 334, 332, 52/335, 405.3, 679, 687, 448, 320, 391, 370, 52/371, 369, 351, 353, 361, 363, 379
See application file for complete search history.

(56) References Cited

U.S. PATENT DOCUMENTS 836,589 A * 11/1906 Layfield et al. ..... 52/565
941,080 A * 11/1909 Larsen ..... 52/565
1,033,106 A * 7/1912 Kahn ..... 52/88
1,035,206 A * 8/1912 Lewen ..... 52/426
1,052,207 A * 2/1913 Beckman ..... 52/731.2
1,064,363 A * 6/1913 Moore ..... 52/356
1,183,594 A * 5/1916 Robinson ..... 264/32
1,366,470 A * 1/1921 Lampert ..... 52/714
1,726,496 A * 8/1929 Kinninger ..... 52/370
1,852,042 A * 4/1932 Dean ..... 52/715
1,924,724 A * 8/1933 Olney ..... 52/379
1,936,147 A * 11/1933 Young ..... 52/334
1,963,980 A * 6/1934 Garrett ..... 52/353
1,974,730 A 9/1934 Zollinger
2,009,513 A * 7/1935 Oliver ..... 52/367
2,054,573 A * 9/1936 Mendenhall ..... 52/385
2,236,082 A * 3/1941 Wright ..... 52/700
2,328,453 A * 8/1943 Hopewell ..... 52/426
2,527,985 A * 10/1950 Burroway ..... 52/712
2,742,778 A * 4/1956 Olmstead ..... 52/713
3,494,090 A * 2/1970 Allen ..... 52/713

(Continued)

FOREIGN PATENT DOCUMENTS

DE 882553 * 7/1953 ..... 52/334

(Continued)

*Primary Examiner*—Phi Dieu Tran A
(74) *Attorney, Agent, or Firm*—Young & Thompson

(57) ABSTRACT

A prefabricated, supporting building structure element, such as wall elements (11), floor structures (47) or the like includes a reinforced concrete slab (13) having a plurality of discrete, parallel, horizontally separated, not mutually joined, longitudinally extended stiffening plate elements (15), each having a web (17) with a first longitudinal edge portion (21) embedded in the concrete, such that a considerable portion of the web (17) protrudes freely, substantially perpendicularly from a first side defining surface of the concrete slab (13). The longitudinal edge portion (21) exhibits a substantially wave shaped corbelling from the plane of the web (17).

12 Claims, 3 Drawing Sheets

U.S. PATENT DOCUMENTS

| | | | | | |
|---|---|---|---|---|---|
| 3,559,358 | A | * | 2/1971 | Lohse et al. | 52/379 |
| 4,703,602 | A | * | 11/1987 | Pardo | 52/564 |
| 4,731,968 | A | * | 3/1988 | Obino | 52/309.12 |
| 4,843,779 | A | * | 7/1989 | Whitney Jr. | 52/714 |
| 5,040,344 | A | * | 8/1991 | Durand | 52/127.2 |
| 5,509,243 | A | | 4/1996 | Bettigole et al. | |
| 5,561,957 | A | * | 10/1996 | Gauthier | 52/334 |
| 5,598,675 | A | * | 2/1997 | Pruss | 52/309.4 |
| 5,611,183 | A | * | 3/1997 | Kim | 52/426 |
| 6,041,562 | A | * | 3/2000 | Martella et al. | 52/236.7 |
| 6,148,576 | A | * | 11/2000 | Janopaul, Jr. | 52/426 |

FOREIGN PATENT DOCUMENTS

| | | | | | |
|---|---|---|---|---|---|
| DE | 3836592 | | * | 5/1989 | 52/426 |
| EP | 0 512 135 | A1 | | 11/1992 | |
| FR | 1093673 | | * | 5/1955 | 52/334 |
| FR | 2 652 600 | | | 4/1991 | |
| SE | 507 062 | | | 3/1998 | |
| WO | WO97/46774 | | * | 12/1997 | 52/295 |

* cited by examiner

BUILDING STRUCTURE ELEMENT AND STIFFENING PLATE ELEMENTS FOR SUCH AN ELEMENT

FIELD OF THE INVENTION

The present invention relates to a prefabricated, supporting building structure element, such as wall elements, floor structures or the like comprising a reinforced concrete slab having a plurality of discrete, parallel, horizontally separated, not mutually joined, longitudinally extended stiffening plate elements, each having a web with a first longitudinal edge portion embedded in the concrete, such that a considerable portion of the web protrudes freely, substantially perpendicularly from a first side defining surface of the concrete slab.

The invention also relates to a plate element for stiffening a building structure element of reinforced concrete, such as wall elements, floor structures or the like, where the plate element consists of a longitudinally extended web with a first longitudinal edge portion to be anchored in the concrete with a considerable portion of the web freely protruding from the concrete.

BACKGROUND OF THE INVENTION

With building structures is generally concerned wall elements, floor structures or the like comprising a relatively thin, reinforced concrete slab with a thickness of about 50 mm. These have partially embedded plate elements for stiffening, not reinforcing, the concrete slab, where the embedded portion of the plate elements will be subjected to shear stresses when loading the concrete slab. Thus, great demands are made upon an excellent adherence between the concrete and the stiffening plate elements.

SE 9503498-9 shows a floor frame work comprising a mesh reinforced concrete slab with cast external plate grinders. Cut-in portions are provided at the uppermost edge of the plate girder, which enable generally triangularly shaped tongues to be formed. These tongues are deflectable so as to form the anchor portion of the plate girders in the concrete slab and, as well as, support a mesh reinforcement. Certainly, a strong anchoring and adherence is obtained in the concrete slab, but a complicated and a time consuming method of manufacturing is required.

EP A1 0 512 135 A1 concerns a thick concrete slab with completely embedded, double-bent plates, which plates work as a bottom reinforcement of the concrete slab. The plates are mutually joined, thus working as a casting mould when forming the slab, by means of bending the one of two adjacent plates over the other plate, whereupon this overbending is corrugated in the longitudinally direction of the plates, thereby exhibiting a wave shaped corbelling.

SUMMARY OF THE INVENTION

One object of the present invention is to provide a joint acting structure, including a plurality of stiffening plate elements and a thin concrete slab, employed in various building structure elements, such as walls and floor structures. Since a thin concrete slab is used, the stiffening elements need to be anchored shallowly, putting great demands on the adherence between the embedded portion of the stiffening plate elements and the concrete. Furthermore, it is of great importance that this adherence may be obtained in a simple and inexpensive way.

This object is achieved by means of a building structure element, as initially defined, and characterised in that the longitudinal edge portion exhibits a substantially wave shaped corbelling from the plane of the web.

By a wave shaped corbelling is generally meant a continuously connected wave shape having a substantially decided sine shape, even though discontinuously connected wave shapes having sine-, tooth-, zigzag or the like, are conceivable. By giving the embedded portion of the stiffening plate elements a wave shaped corbelling, a strong anchoring in the concrete is obtained, which anchoring can manage greater shear stresses. Furthermore, the wave shaped corbelling can be anchored with a lesser embedded depth compared to SE 9503498-9, 10 to 15 mm instead of 35 mm. Hereby, the wave shaped corbelling does not collide with existing reinforcement in the concrete slab, the plate elements do not "cut up" the concrete slab in the same extension as in SE 9503498-9, and finally, the space requirements in the lateral directions are reduced.

Furthermore, an "extension" of the plate is achieved due to the corbelling, since the embedded effective length of the plate element increases. By means of this "extension" a cold working of the plate is obtained which increases the hardness of the steel and thus increases the strength of the joint. A further, great advantage is also that the wave shaped corbelling may be produced by means of considerably simpler mechanical equipment compared to SE 9503498-9, which mechanical equipment may as well be co-ordinated with other profiling machinery.

However, the wave shaped corbelling that is to be found in EP A1 0512135 A1 solves completely different problems. Firstly, it facilitates the mutually joining of the various plate elements, so as to firmly hold them together and thereby form an assembled concrete mould structures. Secondly, the whole flat flange portion of the plate is embedded in the concrete, which only results in a force transmittable reinforcement that increases the bending strength of the concrete slab, instead of stiffening the structure, as in the case of the present invention with its partially embedded plate webs.

Another object of the invention is to provide a plate element for stiffening of a building structure element as initially defined.

BRIEF DESCRIPTION OF THE DRAWINGS

Preferred embodiments of the present invention will now be described with reference to the appended drawings, in which.

DETAILED DESCRIPTION

Figure 1:
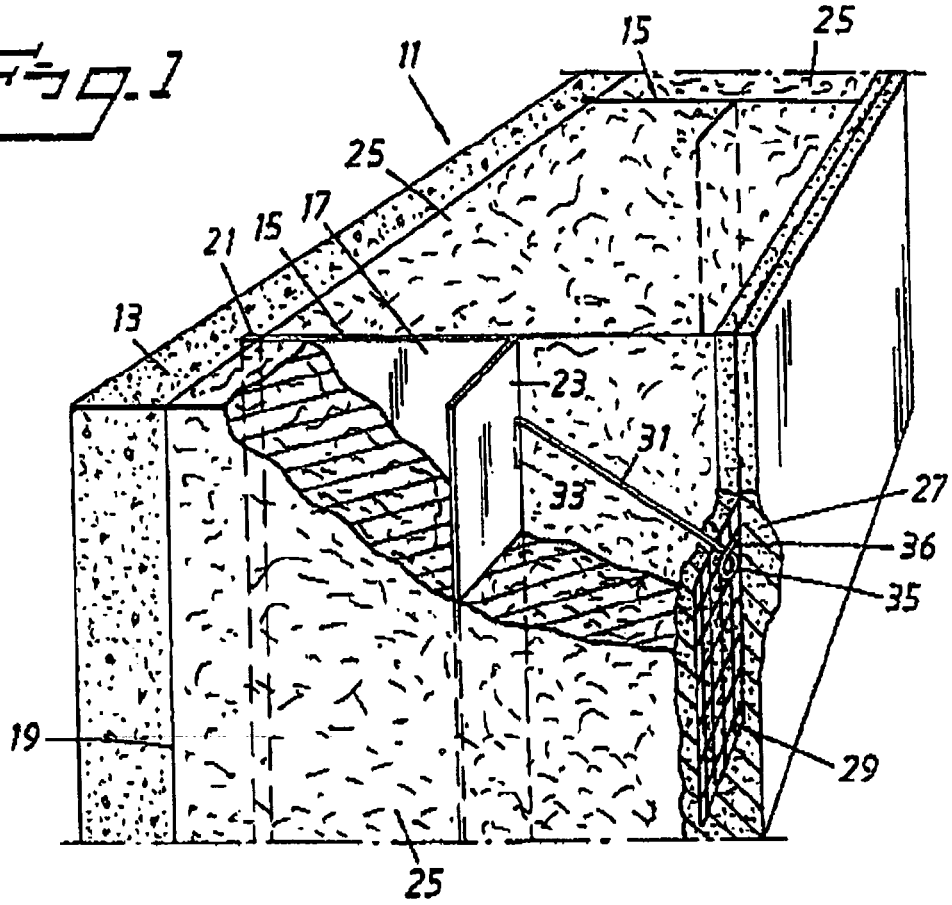
FIG. 1 is a cut-away, perspective view of a wall structure element with embedded stiffening plate elements according to a first embodiment of the invention.
Figure 2:
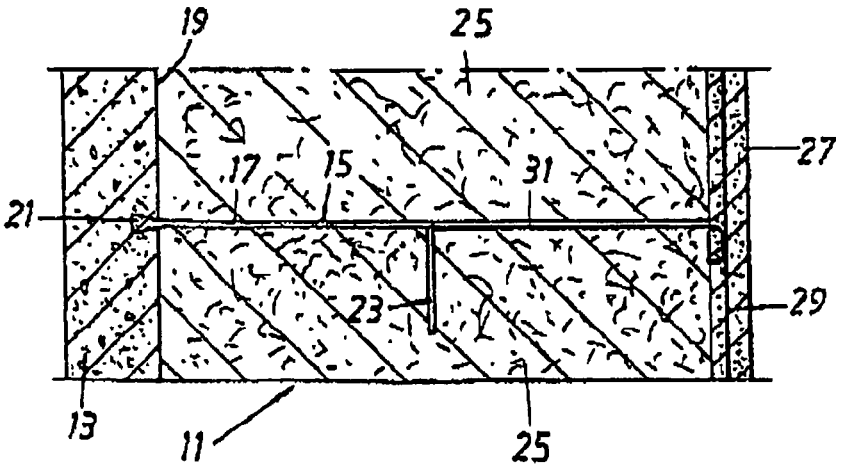
FIG. 2 is a top, cross-sectional view of FIG. 1.

FIGS. 1 and 2 show a supporting wall structure element 11 according to a first embodiment of the invention, where the wall structure element 11 comprises a vertical, reinforced, preferably steel fibre reinforced, concrete slab 13 with a plurality of embedded stiffening plate elements 15, and intended to form a supporting external- or intermediate wall, where the stiffening plate element 15 aiming to stiffen the wall structure element 11 so it more easily can absorb stresses due to compression or bending moments.

Figure 3:
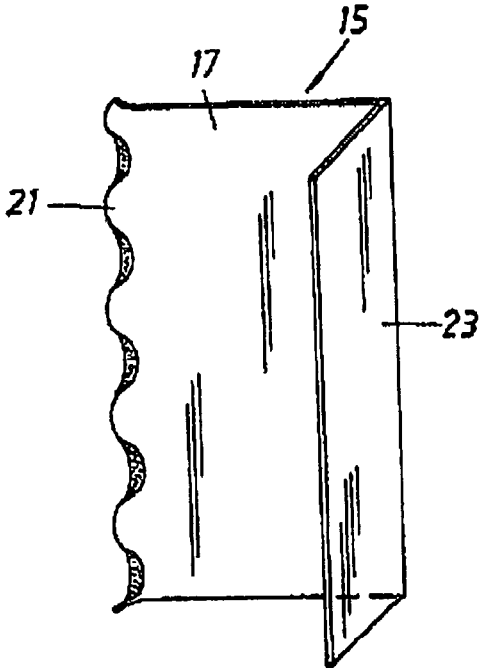
FIG. 3 is a perspective view of the stiffening plate element in FIG. 1.
Figure 4:
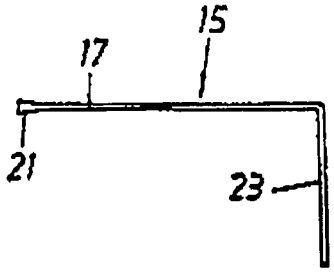
FIG. 4 is an end view of the stiffening plate element in FIG. 3.
Figure 5:
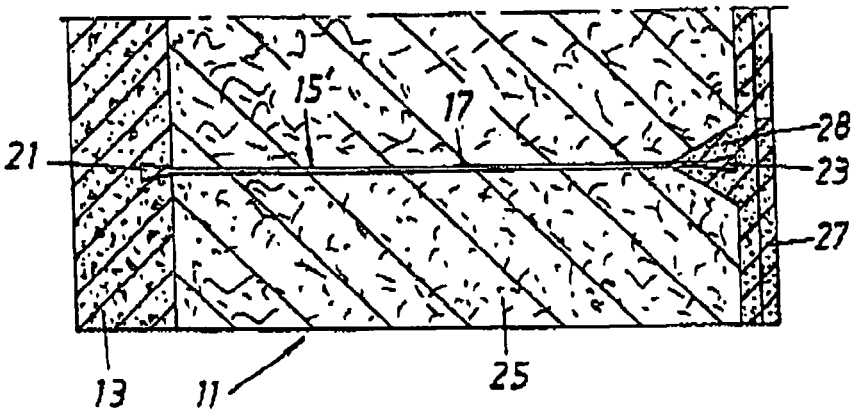
FIG. 5 is a cross-sectional view, analogous with the view in FIG. 2, of a wall structure element with a stiffening plate element according to a second embodiment of the stiffening plate element.

The stiffening plate elements 15 are substantially vertically orientated, horizontally separated, as well as discrete and parallel in relation to each other, each having a web 17, where a considerable portion of the web protrudes freely and substantially perpendicularly from a first side defining surface 19 of the concrete slab 13. The stiffening plate elements 15, which are not mutually joined, are anchored in the concrete slab 13 by means of a first longitudinal edge portion 21 of the web 17 and, which can be seen from FIGS. 3 and 4, exhibit a portion that is bent off the plane of the web 17, which may be obtained, e.g. by means of corrugating the first longitudinal edge portion 21. This may be performed along the whole longitudinal edge portion are sectionally along this by means of any know method, e.g. the longitudinal edge portion 21 is rolled between two gear wheel-like rolls, so a wave shaped, unbroken corrugation, or corbelling, preferably with a widest part at a distal end and a continuously tapering width, such as a generally triangular or bell shape when, seen from an end view in FIG. 4 or 5 is obtained.

Accordingly, it is the wave shaped corbelling that forms the anchoring in the concrete, not the flat web 17, and thus absorbs shear stresses presenting the concrete.

This corrugation provides an effective adherence in the concrete and adsorbs those shear stresses acting on the stiffening plate elements parallelly with the web 17 when loading the wall structure element 11. The stiffening plate elements 15 may be manufactured from steel plate, preferably zinc-plated or stainless steel, which admit resistance to corrosion. The thickness of the stiffening plate elements are about 1–3 mm. From a second longitudinal edge portion of the stiffening plate element 15 a flange 23 projects substantially perpendicularly in relation to the web 17.

Between the stiffening plate elements 15 boards 25 of insulating material are applied. Thus, the web 17 of the stiffening plate elements 15 will extend between adjacent boards 25 of insulating material, perpendicularly out from the concrete slab 13. In this embodiment of the invention the boards 25 of insulating material are provided with not shown slots, which are intended to receive the flange 23 of the stiffening plates elements. The slots are preferably located on half the thickness of the boards 25 of insulating material. The location of the slots in the boards 25 of insulating material is not restricted to the center of the insulation layer, but can also have other locations. The slots runs vertically in FIG. 1 and thus, partially with the flange 23. By means of this fit-in the boards 25 of insulating material will be fixed and retained against the concrete slab 13 without requirement of other means for fixating the boards 25. Concerning the flange 23, other shapes than the stated are also conceivable. For example, the bent portion may be double, i.e. T-shaped to fit into the slots of two adjacent boards 25 of insulating material, or oblique instead of a right angle in relation to the web 17, but other shapes are also possible.

Preferably, the boards 25 consist of a substantially compact material, such as cellular plastic or boards made of mineral wool, to allow slot forming in the boards 25.

On the side of the boards 25 which is not facing the concrete slab 13 a grout reinforcement net 29 is attached, which is covered by a grout layer 27. The grout reinforcement net 29 is located on a small distance from the boards 25 of the insulating material, so that the grout reinforcement net 29 will be substantially centered in the grout layer 27.

This centering is accomplished using wire or strip shaped ties 31, which, by means of a first down-bent end portion 33 is mounted in the stiffening plate elements 15, preferably by hooking the first end portion 33 in a recess or hole in the flange 23 of the stiffening plate elements 15. Furthermore, the ties 31 extend away from and, substantially perpendicularly in relation to the concrete slab 13, between the boards 25 of insulating material, so as to abut against the outside of the boards 25 by means of a second end portion 35.

The wall structure element 11 may be produced by means of a method where a horizontally extended mound is filled with fibre reinforced concrete, preferably steel fibre reinforced concrete, to a level that corresponds to the thickness of the concrete slab 13, e.g. 50 mm. The stiffening plate elements 15 is fitted into the slots of the boards 25 of insulating material by means of the flange 23, such that the corrugation 21 of the first longitudinal edge portion protrudes from the boards 25 and forms the portion 21 of the stiffening element plate elements 15 to be anchored in the concrete slab 13. When placing the boards 25 of insulating material, together with the stiffening plate elements 15 fitted into the slots, on the new concrete, this portion will be immersed a predetermined depth in the concrete. The desired anchoring depth depends on the thickness of the concrete slab 13, but with a thickness of about 50 mm, an anchoring depth of about 10–145 mm. is suitable.

Alternatively, in a reversed sense, the concrete may be applied to the already spread out insulation including the stiffening plate elements.

Accordingly, when producing a wall structure element 11 and independently of the amount of poured steel fibre reinforced concrete, the desired anchoring depth of the stiffening plate elements 15 will be constant, since the boards 25 of insulating material together with the stiffening plate elements 15 rest on the concrete surface.

After curing of the concrete slab 13 a solid anchorage as well as a fixation of the boards 25 of insulating material against the concrete slab is obtained with this manufacturing process, such that the stiffening plate elements 15 provide the wall structure 11 with excellent stiffness against buckling and bending.

On the side of the boards 25 of insulating material which is not facing the concrete wall 13, a grout reinforcement net 29 may be attached, which is held against the boards 25 by means of the ties 31, extending between the boards 25, from the second longitudinal edge portion 23 of the stiffening plate elements 15 to the outside of the boards 25. These ties 31 are attached with their first end portions 33 to the stiffening plate elements 15 while they by means of the shank 36 at the second end portion 35 rest against the outside surface of the boards 25. At the second end portions 35 a reinforcement net 29 may be applied, for example by means of tying wires or the like. A grout layer can now be applied to the reinforcement covered side of the boards 25 to form a grout layer 27 with a centered reinforcement as earlier described.

In the embodiment of the wall structure element 11 shown in FIG. 5 a stiffening plate element 15' according to an other embodiment of the invention extends between the boards of insulating material, and then, by means of the second longitudinally edge portion 23 is anchored directly in a group layer 27. This grout layer is located on a distance from the concrete slab 13. In this embodiment both the first and the second longitudinal edge portion 21, 23 is corrugated. The anchoring in the grout layer 27 is preferably performed in a local recess 28 of the group layer 27 by arranging cavities in the boards 25 of insulating material. To avoid thermal bridges in the wall structure element the web 17 of the stiffening plate elements 15' may be provided with not shown slots to reduce the heat transfer in the web 17.

Figure 6A:
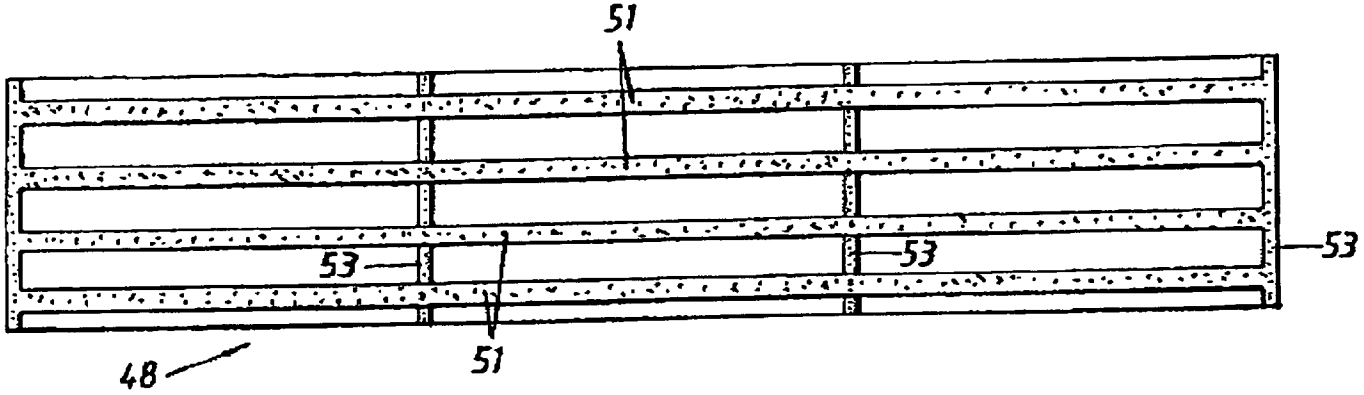
FIGS. 6*a* and 6*b* show a horizontal view and a vertical, cross-sectional view, respectively of a floor structure element with the stiffening plate elements according to the invention.
Figure 6B:
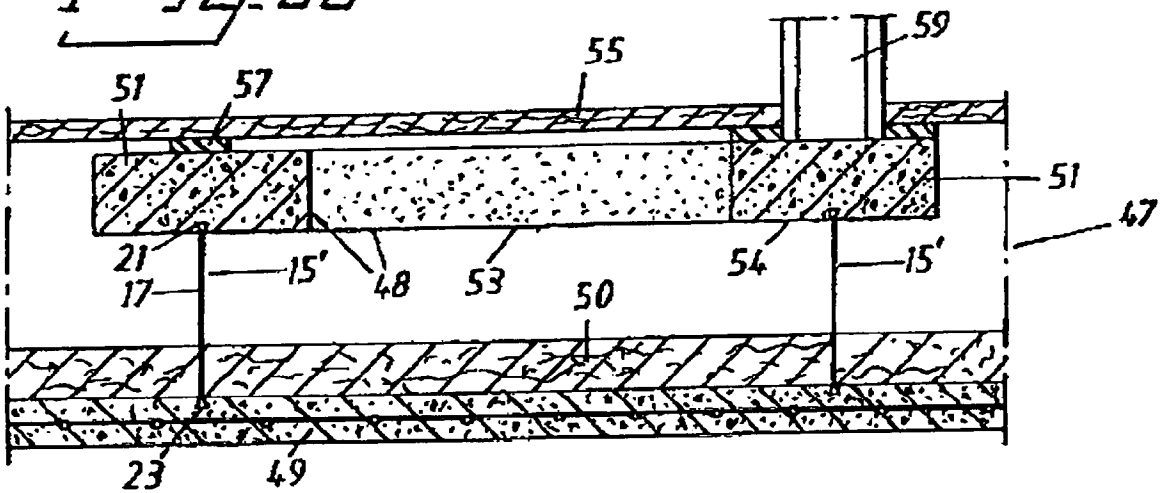

FIGS. 6*a* and *b* show a supporting floor structure 47 of reinforced concrete at which the stiffening plate elements according to the invention may be used. The floor structure 47 comprises an upper frame work 48 of concrete, that is connected to an underlying, horizontal concrete slab 49 (FIG. 6*b*). The framework 48 comprises a plurality of longitudinal, parallel batten elements 51, which are interconnected by means of laterally extending bridges 53, so as to stabilise the framework 48 in the lateral direction. The distance between the batten elements 51 is about 69 cm according to common building codes.

At a lower edge of each batten element 51 stiffening plate elements 15' according to the second embodiment in FIG. 5 is embedded by means of a first, corrugated longitudinal edge portion 21 of the web 17, as earlier described in connection with the wall structure element. Accordingly, the stiffening plate elements are horizontally separated, discrete and parallel in relation to each other. A considerable portion of the web 17 protrudes freely and extends substantially perpendicularly, vertically out from the lower surface 54 of the batten elements 51, and the stiffening plate elements 15' extend along the batten elements 51. The second longitudinal edge portion 23 of the web is anchored in the concrete slab 49 in an analogous manner. Consequently, the frame work 48 will rest on the lower concrete slab 49 by means of the stiffening plate elements 15', and the corrugation will provide an efficient adherence in the concrete that will absorb the shear stresses acting on the stiffening plate elements parallelly with the web 17 when loading the floor structure.

In the interspace between the framework 48 and the lower concrete slab 49 a space for accommodating insulation 50, electrical cables, water- and sewer pipes and the like is provided. On top of the framework 48 a floor layer 55 can be attached, such as chip boards, parquet of the like. Suitably, a vibration absorbing supply of e.g. Sylomer is arranged between the floor layer 55 and the floor structure elements 51. The floor structure 47 also manage to support the wall structure element 59.

In the embodiment according to the FIGS. 6*a* and 6*b* the framework 48 is located above the concrete slab 49, but the reverse is also conceivable, if desired.

The invention is not restricted to the use of steel fibre reinforced concrete, but also other fibre reinforcements, such as plastic- or composite fibres, may be used. Furthermore, conventional bar- and wire reinforcement, pretensioned or slack, is conceivable.

What is claimed is:

1. A floor structure element, comprising:

a horizontally extended concrete slab;

a plurality of discrete, parallel, horizontally separated, not mutually joined, longitudinally extended stiffening plate elements, each of such plate elements having a web with a first longitudinal edge portion embedded in said concrete slab and having a vertically extended considerable portion protruding freely, substantially perpendicularly from a first surface of said concrete slab, said first longitudinal edge portion having a wave-shaped corbelling from a plane of the web, and a further horizontally extended concrete element vertically separated from said concrete slab by an interspace that is arranged and adapted to receive at least one of insulation and utility piping, wherein a second longitudinal edge portion of said web opposite said first edge portion has a substantially continuous wave-shaped corbelling from the plane of the web, wherein each said second edge portion is anchored in said further concrete element and said vertically extended portion is free of both of said concrete slab and said further concrete element and defines a height of said interspace, and wherein the wave-shaped corbelling in the first longitudinal edge portion is continuous and a distal edge thereof follows a continuous sinuous path over plural sinusoidal cycles and projects from alternating sides of a plane of the web.

2. The structure element of claim 1, wherein, when viewed form an end, said first edge portion is widest at a distal end and continuously tapers in width to where said first edge portion joins said considerable portion.

3. The floor structure element of claim 1, wherein said first longitudinal edge protein, when viewed form an end, is generally triangular with an apex that joints said considerable portion.

4. The floor structure element of claim 1, wherein said further concrete element is entirely supported by said plate elements.

5. The floor structure element of claim 1, wherein the height of said interspace is least as much as a thickness of said concrete slab.

6. The floor structural element of claim 1, wherein said first longitudinal edge portion is embedded in said concrete slab a distance that is from 20–30% of a thickness of said concrete slab.

7. A building structure elements, comprising:

a concrete slab;

a plurality of discrete, parallel, horizontally separated, not mutually joined, longitudinally extended stiffening plate elements, each of said plate elements having a web with a first longitudinal edge portion embedded in said concrete slab and having a considerable portion protruding freely, substantially perpendicularly from a first surface of said concrete slab, said first longitudinal edge portion extending continuously and having a wave-shaped distal edge that follows a continuous sinuous path over plural sinusoidal cycles and projects from alternating sides of a plane of the web, and a further concrete element spaced from said concrete slab, wherein a second longitudinal edge portion of said web opposite said first edge portion has a substantially continuous wave-shaped corbelling from the plane of the web, and wherein each said second edge portion is anchored in said further concrete element.

8. The building structure element of claim 7, wherein said first longitudinal edge portion, when viewed from an end, is generally triangular with an apex that joins said considerable portion.

9. The building structure element of claim 7, wherein said further concrete element is entirely supported by said plate elements.

10. The building structure element of claim 7, wherein said first longitudinal edge portion is embedded in said concrete slab a distance that is from 20–30% of a thickness of said concrete slab.

11. The building structure element of claim 7, wherein said further concrete element is separated from said concrete slab by an interspace that is arranged and adapted to receive at least one of insulation and utility piping, and wherein each said vertically extended portion is free of both of said concrete slab and said further concrete element and defines a height of said interspace.

12. The building structure element of claim 11, wherein the height of said interspace is least as much as a thickness of said concrete slab.

* * * * *